US006244059B1

(12) United States Patent
Hill

(10) Patent No.: US 6,244,059 B1
(45) Date of Patent: Jun. 12, 2001

(54) EDUCTOR BASED OIL RETURN FOR REFRIGERATION SYSTEMS

(76) Inventor: Herbert L. Hill, 1022 Leawood, St. Louis, MO (US) 63126

( * ) Notice: Subject to any disclaimer, the term of this patent is extended or adjusted under 35 U.S.C. 154(b) by 0 days.

(21) Appl. No.: 09/493,847

(22) Filed: Jan. 28, 2000

Related U.S. Application Data

(60) Provisional application No. 60/130,738, filed on Mar. 19, 1999.

(51) Int. Cl.[7] ..... F25B 31/00
(52) U.S. Cl. ..... 62/193; 62/468
(58) Field of Search ..... 62/84, 193, 194, 62/468

(56) References Cited

U.S. PATENT DOCUMENTS 4,404,812 * 9/1983 Zinsmeyer ..... 62/84
5,894,740 * 4/1999 Renz ..... 62/468

* cited by examiner

*Primary Examiner*—William E. Tapolcal
*Assistant Examiner*—Mohammad M Ali
(74) *Attorney, Agent, or Firm*—Daniel Kramer

(57) ABSTRACT

In a compression type refrigeration system having a volatile refrigerant circulating along with lubricating oil, member for causing oil to flow from a first location to a second location, where the member comprises an educator connected to receive the oil from the first location, a high pressure source within the system connected to the educator, and a connection from the eductor to the second location.

15 Claims, 2 Drawing Sheets

EDUCTOR BASED OIL RETURN FOR REFRIGERATION SYSTEMS

CROSS REFERENCE TO RELATED APPLICATION

This application is entitled to the benefit of Provisional Patent Application Serial No. 60/130,738, Filed Mar. 19, 1999.

BACKGROUND

1. Field of the Invention

This invention relates to refrigeration systems through which a volatile refrigerant is circulated along with oil and to eductor means for causing oil to return to its compressor source without the need for providing gas-flow risers having a high internal gas velocity with its accompanying high pressure drop.

2. Discussion of Prior Art

It is common for refrigerating systems employing one or more compressors for circulating a volatile refrigerant to experience oil transfer from the compressor to the flow stream of volatile refrigerant pumped by the compressor. In larger systems it is common to design vapor flow piping with internal vapor velocities high enough to ensure entrainment of such oil so that it can be reliably carried back to its source, the compressor. It is admitted that the smaller pipes needed to generate the higher vapor velocities have a reduced first cost. However, the higher internal vapor velocities required for this purpose generate vapor pressure drops which degrade system performance and efficiency, thereby imposing higher operating costs for the life of the equipment. The performance degradation is most pronounced where the oil flow is desired to occur in 'suction lines', those pipes carrying refrigerant vapor from a cooling coil or evaporator to a compressor. The portion of systems in which suction lines or pipes or conduits reside are frequently called "low-sides", referring to the lower pressure existing in those pipes or conduits. Since any particular low-side may not be the region of lowest pressure within a given system, the term "lower pressure side" will be used interchangeably with the term lowside.

Compressors ordinarily are constructed with oil sumps or reservoirs. These are substantially always at the pressure of the suction line or conduit from which they pump. Therefore, such reservoirs or sumps are part of the low-side or lower pressure side as well as suctions lines and suction conduits.

While the use of eductors and venturis is well known for pumping waste water and slurries from one point to another, their application for oil return instead of through vertical risers in refrigeration systems is not known heretofore.

The term eductor as used herein applies to venturi-type devices having no moving parts. Eductors employ a higher pressure fluid to create an area of lower pressure into which a desired fluid at one location is attracted and conveyed to a second location.

Eductors are also known as venturis, jet-pumps, ejectors, syphons, injectors and aspirators.

They are manufactured by several companies one of which is the Fox Valve Development Corp. located at Hamilton Business Park, Unit 6A, Franklin Road, Dover N.J. 07801.

SUMMARY OF THE INVENTION

In a refrigeration system having at least one evaporator and at least one compressor having a suction side for receiving refrigerant vapor at a lower pressure and a discharge side for discharging refrigerant vapor at a higher pressure; first suction flow means positioned at a lower level for receiving refrigerant vapor and oil from an evaporator and second suction flow means positioned at a higher level for receiving refrigerant vapor from said first refrigerant flow means. The first suction flow means has oil collected therein. Means for transferring the oil collected in the first suction flow means to the second suction flow means. The transferring means comprises: venturi means having a high pressure inlet for receiving higher pressure refrigerant vapor, the venturi means further having a suction inlet including conduit means connected thereto for receiving oil from the first suction flow means; and flow means for conveying oil and higher pressure refrigerant to said second suction flow means.

OBJECTS AND ADVANTAGES

The following objects and advantages pertain to the use of the invention within a compression type refrigerating system or the like:

It is an object of the invention to provide non-mechanical means for moving oil from one location to another location within the suction side of the system.

It is a further object to provide such oil movement with suction mains and risers sized for minimum pressure drop and minimum vapor velocity.

It is a further object to provide such movement by the use of a venturi device.

It is a further object to use vapor from the discharge side of a compressor to activate the venturi.

It is a further object to control the pressure differential between the high pressure venturi inlet and the suction side of the system.

It is a further object to minimize flow of discharge vapor for the purpose by limiting the periods during which the flow occurs.

It is a further object to minimize discharge vapor flow to the lowside by limiting the pressure differential across the venturi.

It is a further object to provide a timer to allow and prevent discharge vapor flow to the venturi according to a predetermined cycle.

It is a further object to limit the periods of discharge vapor flow by sensing the presence and absence of oil and by allowing discharge vapor flow in the presence of oil and stop said flow in the absence of oil.

It is a further object to employ an oil level detector for detecting the presence and absence of oil.

It is a further object to employ a float type level detector for the purpose.

It is a further object to employ a non-float detector for the purpose.

In multistage refrigeration systems it is an object to employ inter-stage pressure to actuate the venturi.

In systems employing screw-type compressors, it is an object to employ pressure from the compressor, selected at a position between the suction inlet and discharge outlet, to actuate the venturi.

It is a further object to provide satisfactory oil return in systems employing higher viscosity oil.

It is a further object to provide satisfactory oil return in system where the lubricant and the refrigerant are not highly soluble in each other.

Further objects and advantages will become apparent as the invention is explained and disclosed in more detail in subsequent sections of this specification.

DETAILED DESCRIPTION OF THE INVENTION

Figure 1:
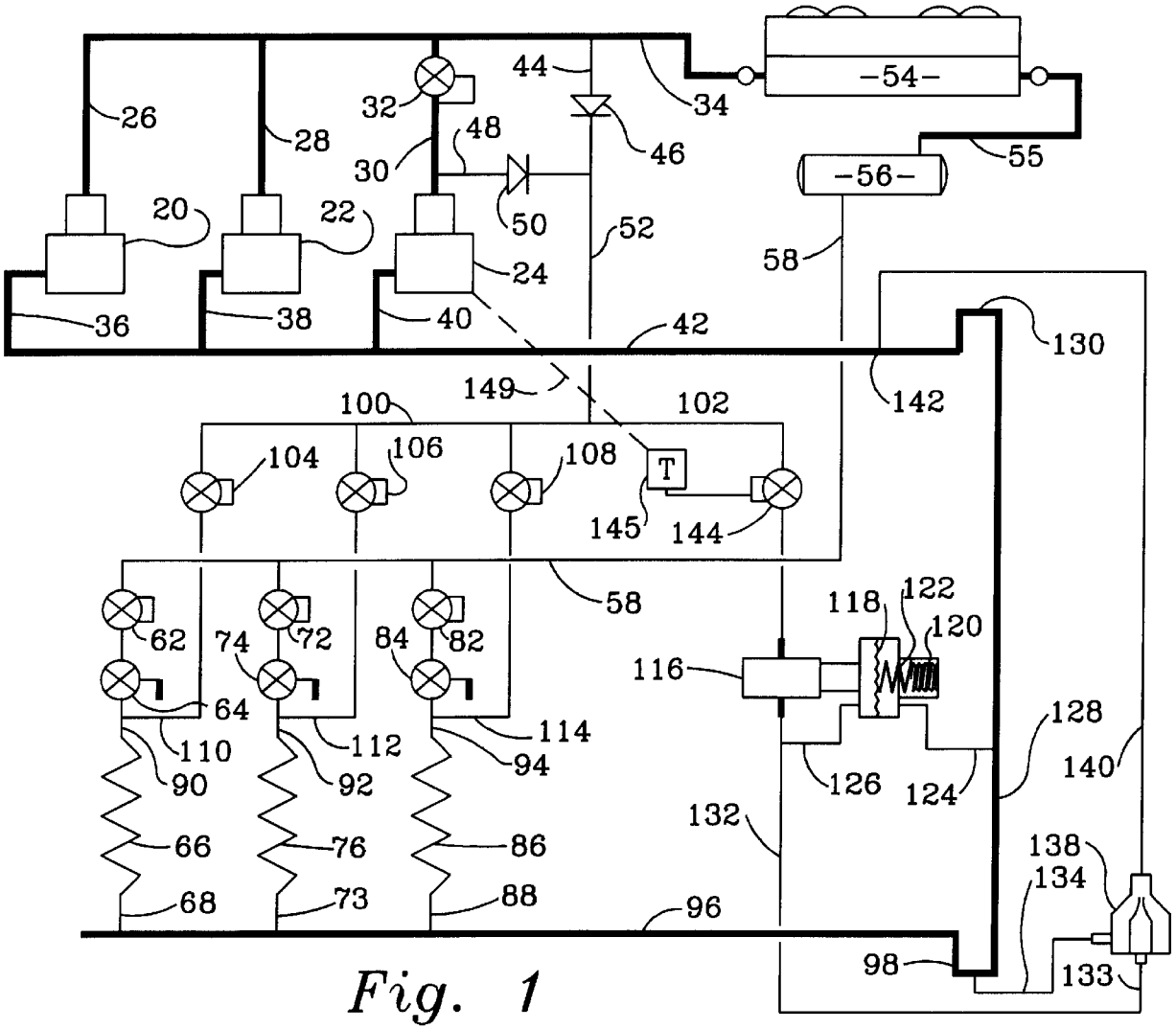
FIG. 1 is an overall schematic piping diagram of a multi-compressor refrigeration system showing one form of the invention.

COMPRESSOR OIL LOSS:

Refrigeration compressors normally discharge some of their lubricating oil along with the compressed refrigerant. The movement of that oil along with the low pressure vapor along suction mains and up suction risers requires sizing the suction riser smaller than high system efficiencies require. Standard practice as set forth in respected guides such as the Handbooks published by the American Society of Heating, Refrigeration and Air-Conditioning Engineers (ASHRAE) require that risers be sized to provide vapor velocities at the lowest loads sufficiently high to provide a pressure drop corresponding to 2F reduction in saturation temperature.

EFFECT ON REFRIGERATING CAPACITY:

This requirement in itself is very severe in simple systems having only a single compressor operating at a single capacity because, under freezer conditions it can cause as much as a 6% loss in compressor capacity. In multi-compressor systems the losses become much worse. Referring to the system of FIG. 1, the suction riser 128, sized for a 2F equivalent pressure drop when only a single compressor 24 runs, will cause almost a 14F equivalent pressure drop when all three compressors 20, 22 and 24 are in operation. This high pressure drop can cause such a sharp reduction in compressor capacity that a larger compressor may have to be selected to offset the capacity loss.

INVENTION OVERCOMES CAPACITY LOSS:

The invention described herein will ensure oil return from one point in the lowside to another without reference to pressure drop, thereby allowing the suction risers and other suction conduits to be sized large enough to minimize pressure losses, even at maximum loads. While the increased pipe size increases the piping cost, the avoidance of increasing the compressor size and the improved compressor capacity and system efficiency more than offset the increased piping cost.

USE OF VENTURI:

In order to provide for the effective and reliable flow of oil from the lower level of suction main 96 to the upper level of suction main 42, a venturi pump or eductor 138 is provided.

Venturis have long been employed as simple pumps and as evacuating devices. Chemistry laboratories have venturis for generating reduced air pressure. These venturis have a high pressure inlet fitting adapted to fit the threads of the water faucet. The suction port is connected by rubber hose to the vessel to be evacuated. In the laboratory case the evacuated material, air, is not recovered but is simply discarded to the drain along with the actuating water stream.

FIG. 1; SYSTEM DESCRIPTION; MULTIPLE COMPRESSORS:

Referring now to FIG. 1, three compressors 20, 22 and 24 are shown. While all three compressors draw from a common suction 42 through their individual suction connections 36, 28 and 40 respectively, in other arrangements, they may be connected to different suctions for a range of applications.

SYSTEM HIGH SIDE:

Each compressor is connected to a common discharge conduit 34 by its individual discharge conduit 26, 28 and 30 respectively. The components between the point of compressor discharge and the expansion device 64, 74 and 84 are known as system "high-side". This refers to the fact that the pressure therein is higher than the pressure in the "low-side". Since other parts of the system may have still higher pressures, the term "higher pressure side" will sometimes be employed to refer to those parts of the system connected directly or indirectly to the discharge connection of the compressor. elsewhere.

Therefore, Discharge conduit 34 conveys the refrigerant vapor discharged by any or all of the three compressors to air-cooled condenser 54 which removes the heat of condensation from the hot compressed refrigerant vapor and condenses the vapor to a liquid refrigerant. The liquid refrigerant flows to a storage vessel 56, also known as a receiver and thence flows via liquid line 58 to the evaporators.

EVAPORATORS:

While FIG. 1 shows three evaporators 66, 76 and 86, there is no suggestion that more than one evaporator is required. Further while the evaporators are shown as substantially identical, there is no intent or suggestion that they are positioned in the same enclosure or employed for the same purpose. For instance, Evaporator 66 could be the freezing part of an ice maker; evaporator 76 could be installed in a walk-in cooler and evaporator 86 could be positioned in an open display case for fresh foods. Each evaporator has an inlet conduit, 90, 92 and 94 respectively and an outlet conduit 68, 73 and 88 respectively. Liquid line 58 conveys its liquid refrigerant to each evaporator through a liquid solenoid and a thermostatic expansion valve (TXV). Evaporator 66 receives liquid via liquid solenoid 62 and TXV 64; evaporator 76 received liquid through liquid solenoid 72 and TXV 74 and evaporator 86 receives liquid through liquid solenoid 62 and TXV 84. The cooling action of each evaporator is controlled by the opening and closing of its liquid solenoid. The solenoids are actuated by means not shown. Each solenoid could be actuated by a different type of control; for instance, solenoid 62 by an ice level detector, solenoid 72 by a thermostat controlling the temperature of the walk-in cooler and solenoid 82 by a thermostat sensing the temperature of the food in the display case.

HOT GAS DEFROST:

Each evaporator is shown having a hot-gas connection for defrosting, if required. The hot gas is provided from hot-gas main 52 which is connected to outlet branches 100 and 102. Branch 100 supplies hot gas for the purpose of defrosting one or more of the evaporators. The defrost function is controlled by the action of one or more of the hot gas solenoid valves 104, 106 and 108. Defrost for each evaporator may be initiated and terminated by a control dedicated to that evaporator or, if all evaporators serve a common function, by a control common to them all.

Hot gas main 52 is supplied from the discharge or higher pressure side of one or more of the compressors 20, 22 or 24. In order for the hot gas to perform its defrosting function it must be maintained at or above a pressure corresponding a temperature above about 80F. For HFC-134a this is about 87 pounds per square inch gage pressure (psig). Gage pressure is simply absolute pressure less standard atmospheric pressure or 14.7 psi.

DISCHARGE PRESSURE CONTROL:

However, air cooled condenser 54 when exposed to air temperatures lower than 50F. is likely to produce condensing temperatures less than required for defrosting. Therefore inlet pressure regulating valve 32 is provided in compressor discharge connection 30 and the hot gas main 52 is connected to the compressor side of valve 32 so that even if the condenser 54 is exposed to low air temperatures, the gas pressure in discharge conduit 30 and therefore branch conduit 48 and hot gas main 52 (all on the "higher pressure side") will always be maintained at a pressure greater than 87 psig. Naturally, the setting of valve 32 depends on the refrigerant employed. For instance, valve 32 would be set for 84 psig if CFC-12 were the refrigerant and 144 psig if HCFC-22 were the refrigerant, since these are the pressures most closely corresponding to a saturation or equivalent temperature of 80F.

CHECK VALVE FUNCTION:

Should there be need for additional hot gas, branch 44 is provided to convey hot gas from discharge main 34 to hot gas main 52. Check valves 50 and 46 are provided to prevent interaction. That is, if discharge main 34 has a pressure lower than the desired pressure, the higher pressure gas in discharge branch 30, generated by control valve 32, cannot be dissipated into the lower pressure within discharge main 34, since flow from conduit 48 to conduit 44 is prevented by check valve 46.

The application of control valve 32 and check valve 46 provides sufficient pressure both for hot gas defrost and the effective utilization of the venturi of the invention; as follows:

VENTURI PRESSURE DIFFERENTIAL VALVE:

The function of venturi or eductor 138 is to evacuate accumulated oil from lower suction main 96 and deliver it either directly to one or more of the compressors 20, 22, and 24, or to an oil reservoir for feeding oil to the compressors or, as shown in FIG. 1, to upper suction main 42. To perform this function in a controlled manner, venturi 138 must be provided with a supply of refrigerant vapor at a pressure well above the operating suction pressure in upper suction main 42 and lower suction main 96. As explained above, the normal discharge pressures with minimum established by inlet pressure control valve 32 serve this purpose. Typically, the pressure in the hot gas conduit 133 delivering gas to the eductor inlet 148 should be maintained about 80 psi higher than the suction pressure though a suitable range for operation is from 40 to 120 psi. Since, during summer operation the condensing pressure and therefore the pressure in conduit 52 will correspond to temperatures of 100F. or above (124 psig or greater for HFC-134a), the pressure in conduit 52 which supplies hot gas from the compressor discharge conduit will be much higher than 80 psi above suction pressure, means for controlling the pressure supplied to the eductor inlet is desirable to maintain predictable performance of the eductor and to prevent excessive high pressure gas flow to the suction side. For this purpose an adjustable pressure differential valve 116 is supplied. Pressure differential valve 116 employs diaphragm or bellows 118 to sense the differential pressure of interest. One side of diaphragm 118 is exposed to the outlet or controlled pressure of valve 118 in conduit 132 via conduit 126. The other side of diaphragm 118 is exposed to the suction pressure via conduit 124. The suction pressure for this purpose may be sensed in riser 128, in lower suction main 96 or upper suction main 42 or even directly at one or more of the compressors. A spring 122 applies a biasing pressure to diaphragm 118. The spring biasing pressure is adjustable by adjusting screw 120 which compresses spring 122 more or less as required to secure the desired pressure differential between the vapor in conduits 132/133, the higher pressure side, and the suction pressure, the lower pressure side. Sporlan Valve Company provides a Model DBV valve as described in their Bulletin 90-40 dated September 1994, which need only be modified by the addition of a connection for conduit 124 (FIG. 1) in the adjustable spring chamber.

SUCTION OIL TRAP:

In order to conserve energy and to improve system efficiency and compressor performance, riser 128 is designed and selected for pressure drop which is too low to assure oil entrainment and flow up riser 128, especially at lowest loads when only compressor 24 may be in operation. Therefore, under these conditions at least, oil discharged by the compressor/s along with the hot discharge vapor that is circulated along with the refrigerant into the evaporators will accumulate in lower suction main 96. To better address this and to help ensure collection of uncirculated oil in one easily drained spot, oil trap 98 is provided. While the term trap is employed here to refer to a U-shaped portion of tubing, the term trap as employed herein will also refer to a vessel 158 and similar constructs intended to catch and, at least temporarily retain, oil flowing within the conduit supplying it such as conduit 96.

Figure 2:
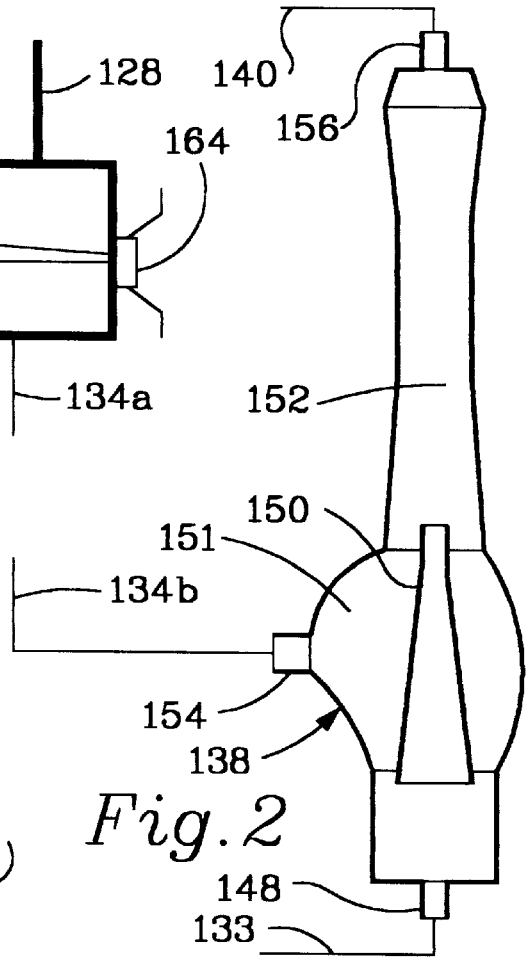
FIG. 2 shows a crossection of a typical venturi or eductor device used in the invention.

DETAILED DESCRIPTION OF EDUCTOR:

With combined reference now both to FIGS. 1 and 2, conduit 134 connects the bottom of trap 98 with the suction inlet 154 of eductor 138. The higher pressure vapor flowing into eductor inlet 148 from hot gas inlet conduit 133 is directed through eductor nozzle 150 having a reduced diameter and thereby generating a very high gas velocity in chamber 152. The high velocity gas induces a low pressure in the inlet chamber 151 to which suction inlet 154 of the eductor 138 is connected as shown. The reduced pressure in the eductor inlet chamber 151 establishes oil flow from trap 98 through conduit 134 into the eductor. The oil is ejected from the eductor via outlet port 156 by the high velocity gasses and transmitted through conduit 140 to a second location 142 in the lower pressure side.

OIL TRANSFER POINTS; UPPER TRAP:

While connection point 142 is shown positioned in the upper suction main, it can be positioned anywhere at the upper level that flow to the compressor/s is assured. Inverted trap 130 is provided to ensure that oil deposited in the upper suction main does not again flow back down riser 128 during off-cycles or low load conditions.

Other potential "second location" connection points for return of oil from the outlet 156 of eductor 138 are any point in the lower pressure side of the system. An example of such second or alternate location is a connection point within the crank compartment/oil reservoir of one or more compressors 20, 22 and 24 to which conduit 140 will be connected for the purpose.

SYSTEM CAPACITY DEGRADATION FROM VENTURI OPERATION:

High suction pressure drops most severely penalize lower temperature refrigeration systems, that is, those that serve freezers. However, the delivery of unnecessary vapor, however little, from the high side to the lowside of any refrigeration system also degrades its performance. Since the operation of the eductor requires the transmission of a small volume of high pressure vapor to the lowside, means to limit the quantity of such vapor transmission are provided.

VENTURI OPERATION, CYCLE TIMER:

A preferred construction comprises solenoid valve 144 positioned to allow and prevent flow in conduit 102 that delivers high pressure vapor to the eductor. In this preferred embodiment the operation of solenoid 144 is controlled by percentage timer 145. The power for the timer/solenoid is provided from the compressor circuit via connection 149 in such a way that the timer can operate and solenoid 144 can be energized and open only during periods of compressor operation. Typically the timer causes the solenoid to be open 10% of the compressor operating time, though the range of adjustment of the timer would typically allow the user to adjust the solenoid open period from 5% to 50% or more if required to ensure the scavaging of oil from the lower level suction main and its proper return of oil to the compressor.

Figure 4:
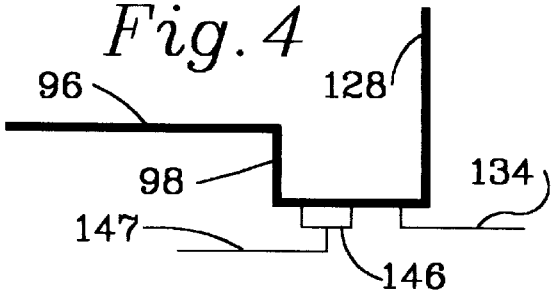
FIG. 4 illustrates one form of an oil sensing detector positioned wholly outside the suction conduit.

VENTURI OPERATING CYCLE, EXTERNAL SENSOR:

A more precise and alternate preferred embodiment of the invention provides a liquid sensor (FIG.4) 146 positioned in operative relation to the trap. Sensor 146 is adapted to detect the presence of a quantity of liquid, such as oil, within the trap and to cause solenoid valve 144 to open via control line 147 when a larger quantity of liquid in the trap is detected and to close when a smaller quantity of liquid in the trap is detected. Sensor 146 may be of the ultrasonic type or the Doppler type. Alternately it may have the form of a thermostat whose temperature is biased by a heater, not shown. In the absence of oil the thermostat will be cold because the inner wall of the trap will be exposed to cold suction vapor, causing it to keep solenoid 144 closed. In the presence of oil, the oil is warmed by the heater, allowing the thermostat to become warm and cause the solenoid valve 144 to open and thereby cause the venturi to evacuate accumulated oil from the bottom of the trap 98.

Figure 3:
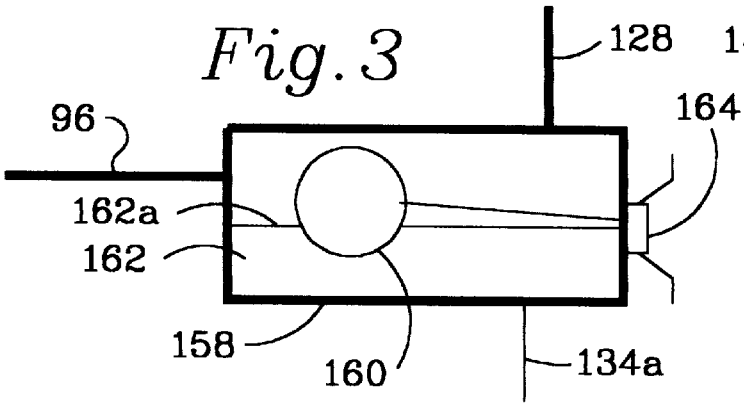
FIG. 3 is a schematic representation of a suction oil trap with internal float and switch employed to actuate the venturi when required.

VENTURI OPERATING CYCLE, FLOAT:

Referring now to FIG. 3, a vessel 158 is provided in lieu of trap 98. Within the vessel is positioned float 160 which actuates sensor 164. Sensor 164 is a switch in one embodiment of the invention and is a valve in a second embodiment. The float 160 floats on a pool 162 of collected oil having a surface level 162*a*. When the float rises to a predetermined higher position by virtue of accumulation of more oil in pool 162, switch 164 closes. This causes solenoid 144 to open, allowing high pressure vapor to flow to the venturi, thereby evacuating oil from vessel 158 and lowering oil level 162*a* within vessel 158. When the oil level 162*a* within vessel 158 falls to a second predetermined level, switch 164 open, This causes solenoid 144 to close, stopping high pressure vapor flow to the venturi. In an alternate construction element 164 is a valve positioned in conduit 102. The valve 164 is arranged to open when float 160 rises to a first predetermined level and to close when the oil level 162*a* falls to a second predetermined level.

VENTURI CYCLE SUMMARY

By the improved embodiments described above the eductor is allowed to operate only when a larger quantity of oil is present at the lower level and caused to stop operation when the quantity of oil at the lower level is reduced to a smaller quantity, thereby providing that the unnecessary flow of high pressure vapor into the lowside is controlled and substantially eliminated.

Figure 5:
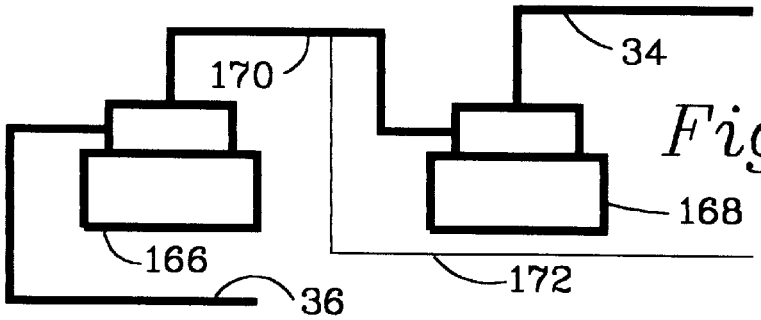
FIG. 5 is a schematic representation of two compressors piped in a compound compression arrangement with a gas takeoff for actuating the venturi of the invention.

COMPOUND COMPRESSION SYSTEMS:

Where very low temperature systems are needed, compound compression is employed as shown in FIG. 5. This allows a different and more efficient source for higher pressure vapor for actuating the eductor. In FIG. 5 low stage compressor 166 cools an evaporator via its suction line 36. Low stage compressor 166 discharges its compressed vapor at intermediate pressure into the suction of high stage compressor 168 via interstage conduit 170. High stage compressor 168 discharges its vapor to a condenser not shown. Vapor for actuation of the eductor is removed from the interstage conduit 170 through conduit 172. Referring to FIG. 1, instead of conduit 102 being connected to solenoid valve 144, the intermediate pressure vapor provided from conduit 172 is so connected to flow to solenoid valve 144.

Figure 6:
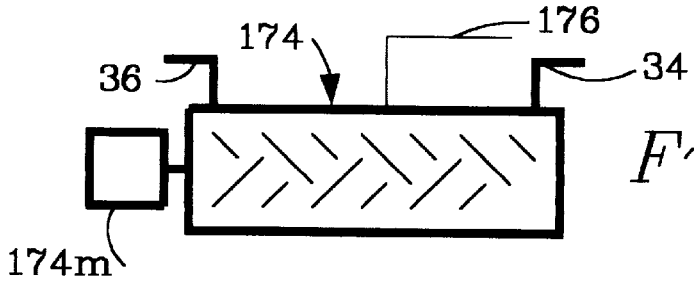
FIG. 6 is a schematic representation of a screw compressor showing the suction and discharge ports and an intermediate port, employable simultaneously as an interstage suction port and as a discharge port, for actuation of the venturi of the invention.

SCREW COMPRESSOR:

In FIG. 6 a screw compressor 174 is provided having suction conduit 36 and discharge conduit 34 and driven by motor 174*m*. Since the pressure of the suction vapor rises over the length of the screw, intermediate pressure vapor is removed from the compressor by conduit 176 which is connected midway between suction inlet 36 and discharge outlet 34. Intermediate pressure conduit 176 is connected to solenoid 144 as a controlled source of higher pressure vapor for controlled operation of the eductor 138.

INTRODUCTION TO CLAIMS:

From the foregoing description, it can be seen that the present invention comprises an advanced design for providing effective oil return in a refrigeration system without the need for reducing system efficiency by the imposition of high pressure drop suction risers. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. A refrigerating system having a higher pressure side and a lower pressure side, the lower pressure side having a first location wherein oil is accumulated and a second location;

means for moving the accumulated oil to the second location, said means comprising:

a venturi actuated eductor having a lower pressure inlet connected to the first location, a higher pressure vapor inlet connected to the higher pressure side and an outlet connected to the second location.

2. A refrigerating system as recited in claim 1, further providing that the first location and the second location are at different elevations and the second location is at a higher elevation than the first location.

3. A refrigerating system as recited in claim 1 further providing a compressor conduit-connected to the higher pressure side and regulating valve means positioned in the conduit to preventing the pressure in the higher pressure side from falling below a predetermined minimum.

4. A refrigerating system as recited in claim 1 where the low pressure side includes a suction conduit and the first location is at a first position in the suction conduit.

5. A refrigerating system as recited in claim 4 further providing a compressor connected to provide the higher pressure and the lower pressure within the respective sides, said compressor having an oil reservoir, where the second location is said reservoir.

6. A refrigerating system as recited in claim 4 where the suction conduit at the first position includes a trap.

7. A refrigerating system as recited in claim 6 where the trap is in the form of a U-shaped tubing section.

8. A refrigerating system as recited in claim 6 where the trap is in the form of a vessel.

9. A refrigerating system as recited in claim 6 where the connection between the higher pressure side and the higher pressure vapor inlet of the eductor is a conduit containing valve means for controlling flow to the higher pressure eductor vapor inlet.

10. A refrigerating system as recited in claim 9 where the valve means includes means for maintaining a constant pressure differential between the pressure at the higher pressure eductor inlet and the lower pressure side.

11. A refrigerating system as recited in claim 9 further providing detection means at the trap for detecting the presence and absence of an accumulation of oil therein and opening the higher pressure valve means in the presence of an oil accumulation and closing said valve means in the absence of an oil accumulation.

12. A refrigerating system as recited in claim 9 further providing timer means for causing the valve means to open at one time and close at another time.

13. A refrigerating system as recited in claim 11 further providing that the detection means is positioned within the trap.

14. A refrigerating system as recited in claim 11 further providing that the detection means is positioned outside the trap.

15. A refrigerating system as recited in claim 12 where the timer is connected to operate only when the compressor operates.

* * * * *